US006257180B1

(12) United States Patent
Klein

(10) Patent No.: US 6,257,180 B1
(45) Date of Patent: Jul. 10, 2001

(54) FORCED COAXIALLY VENTILATED TWO STROKE POWER PLANT

(76) Inventor: Jeffrey F. Klein, 115 Sudbrook La. Ste 205, Pikesville, MD (US) 21208

( * ) Notice: Subject to any disclaimer, the term of this patent is extended or adjusted under 35 U.S.C. 154(b) by 0 days.

(21) Appl. No.: 09/454,773

(22) Filed: Dec. 3, 1999

Related U.S. Application Data

(60) Provisional application No. 60/164,252, filed on Nov. 8, 1999.

(51) Int. Cl.[7] ..... F02B 33/22
(52) U.S. Cl. ..... 123/70 R
(58) Field of Search ..... 123/65 R, 70 R, 123/73 C, 65 B, 70 V, 21; 137/528, 538

(56) References Cited

U.S. PATENT DOCUMENTS

| | | | | |
|---|---|---|---|---|
| 1,389,337 | | 8/1921 | Wolfard . | |
| 1,773,995 | | 4/1930 | Goldsborough . | |
| 2,522,649 | * | 9/1950 | Tenney | 123/70 R |
| 3,880,126 | | 4/1975 | Thurston et al. . | |
| 3,991,721 | * | 11/1976 | Hurd | 123/1 R |
| 4,157,080 | | 6/1979 | Hill . | |
| 4,781,155 | * | 11/1988 | Brucker | 123/70 V |
| 5,228,415 | * | 7/1993 | Williams | 123/51 R |
| 5,275,134 | * | 1/1994 | Springer | 123/42 |
| 5,299,537 | | 4/1994 | Thompson . | |
| 5,431,130 | * | 7/1995 | Brackett | 123/70 R |
| 5,499,605 | * | 3/1996 | Thring | 123/70 R |

* cited by examiner

*Primary Examiner*—Noah P. Kamen
*Assistant Examiner*—Hai Huynh
(74) *Attorney, Agent, or Firm*—Law Offices of Royal W. Craig

(57) ABSTRACT

An internal combustion engine having two parallel cylinders, namely, an induction cylinder and a power cylinder, whereby the power, ventilation (comprising simultaneous intake and exhaust), and compression events within the power cylinder completely define the cycle of the engine, with induction in the induction cylinder being an auxiliary and incidental function to the cycle within the power cylinder, such that engine cooling and fuel efficiency are improved over prior art internal combustion engines. Interconnecting the power cylinder and the induction cylinder is a transfer chamber which opens into the top of the power cylinder, which chamber in turn is equipped with a one way, pressure responsive transfer valve for allowing air to flow into the power cylinder when pressure therein falls below the pressure in the induction cylinder. An exhaust port is likewise positioned near the bottom of the power cylinder. With the exhaust port thus positioned just above the bottom of the stroke of the power cylinder, and with the inlet valve located at the opposite end of the cylinder, fresh air flows in the axial direction of the cylinder towards the exhaust port, cooling the surfaces of the cylinder and the piston as it flows. As the piston closes the exhaust port during its up stroke, the pressure within the power cylinder immediately increases to more than that of the transfer chamber, thus closing the transfer valve and trapping the air which will be used for the next combustion event.

17 Claims, 3 Drawing Sheets

FORCED COAXIALLY VENTILATED TWO STROKE POWER PLANT

CROSS-REFERENCE TO RELATED APPLICATIONS

The present application is based upon and gains priority from U.S. Provisional Patent Application Ser. No.: 60/164,252, filed Nov. 8, 1999 by the inventor herein and entitled "FORCED COAXIALLY VENTILATED TWO STROKE POWER PLANT."

BACKGROUND OF THE INVENTION

1. Field of the Invention

The present invention relates to internal combustion engines and, more particularly, to an internal combustion engine having a superior cycle comprised of three events, namely, compression, combustion, and ventilation, accomplished in two strokes with greater efficiency than has heretofore been made available through the prior art.

2. Description of the Background

Many internal combustion engines operate on a cycle known as the Otto Cycle which has been known since as far back as the year 1801. Whether one is explaining the operation of a two cycle engine or a four cycle engine, the Otto Cycle defines four basic events that occur within the engine during the cycle, namely, intake (or induction), compression, power (or ignition), and exhaust.

In a four stroke engine, approximately one stroke (180 degrees of the 720 degree cycle) is devoted to each event. While modern high speed four stroke engines have attempted to incorporate near simultaneous intake and exhaust, these events still require two separate strokes in a four stroke engine. In such an arrangement, all of the airflow occurs at the top of the cylinder, which tends to help to cool the cylinder head, but which fails to cool the cylinder body. Further, in such a configuration, the power stroke can comprise at best no more than 22% of the cycle, thus limiting the overall power output potential of the engine.

In a two stroke engine, power, exhaust, and intake all occur on the down stroke, followed by additional exhaust and compression on the up stroke. The familiar two stroke internal combustion engine defines four distinct events within the combustion cylinder during its cycle. Beginning with the ignition of the fuel/air mixture in the cylinder, pressure rises above the cylinder head to drive the piston downward through the cylinder. While traveling downward through the cylinder, the piston uncovers an exhaust port to expose the cylinder (which is under high pressure) to near atmospheric pressure, and the combustion products previously held within the cylinder force themselves out of the cylinder through the exhaust port. The piston continues its downward travel through the cylinder to then uncover an intake port prior to the piston reaching its bottom dead center position. During the return stroke (or "up stroke"), the intake port is first closed by the piston. However, for at least a brief period, the exhaust port remains open as the piston continues to travel upward in its return stroke. Thus, some of the fresh air taken in through the intake port and a portion of any fuel that has thus far been mixed into that air is likewise forced out of the exhaust port until the piston closes the exhaust port by passing it during its return stroke. Once the exhaust port is closed, the remaining air and fuel mixture is compressed. Once compression is completed, the two cycle process is finished, and ignition of the fuel/air mixture occurs once again to start the cycle anew. Unfortunately, the period of the cycle during which the piston travels from its bottom dead center position to the top of the exhaust port results in a significant loss of fresh air and fuel which could be used as part of the combustion product.

Another feature of a typical two stroke engine is that the crankcase in a two stroke engine provides a volume of space in which much of the carburetion takes place. This configuration prevents the use of a volume of oil splashing around in the crankcase as is normally the case with a traditional four stroke engine. Thus, in a two stroke engine, oil must be mixed with the fuel prior to its introduction into the cylinder, creating either an additional burden on the user who must mix the fuel and oil prior to use, or requiring more complex fuel and oil delivery systems, while producing an environmentally unfriendly exhaust product which includes burnt oil as a combustion byproduct.

It would therefore be advantageous to provide an improved internal combustion engine which enables the air being inducted into a combustion chamber to participate in cooling the entire cylinder, which increases the efficiency of previously known two cycle engines without requiring the complexity and additional weight associated with four cycle engines, and which prevents the need to use a fuel/oil mixture in a two cycle engine configuration.

SUMMARY OF THE INVENTION

It is, therefore, an object of the present invention to provide an internal combustion engine which avoids the disadvantages of the prior art.

It is another object of the present invention to provide an internal combustion engine which introduces cool air into a combustion cylinder to contribute to cooling the entire length of the combustion cylinder.

It is still another object of the present invention to provide an internal combustion engine which increases the efficiency of previously known two cycle engines without increasing the complexity or weight to that of four cycle engine.

It is yet another object of the present invention to provide an internal combustion engine having the benefits of a traditional four cycle engine while extending the power stroke to 25 to 40 percent of the total cycle.

It is still yet another object of the present invention to provide an internal combustion engine which increases the amount of air charge which may be retained within a combustion cylinder to participate in the combustion event over what has been previously available in traditional two stroke engines.

It is even yet another object of the present invention to provide an internal combustion engine which eliminates the need to mix oil with fuel in a traditional two stroke engine configuration.

According to the present invention, the above-described and other objects are accomplished by providing an internal combustion engine having two parallel cylinders, namely, an induction cylinder and a power cylinder, whereby the power, ventilation (comprising simultaneous intake and exhaust), and compression events within the power cylinder completely define the cycle of the engine, with induction in the induction cylinder being an auxiliary and incidental function to the cycle within the power cylinder, such that engine cooling and fuel efficiency are improved over prior art internal combustion engines. Within the combustion cylinder, an intake port is provided at the top of the cylinder, which port in turn is equipped with a one way, pressure responsive transfer valve for allowing air to flow into the combustion cylinder when pressure therein falls below the pressure in the induction cylinder.

The cycle of the engine of the instant invention is established as follows. Ignition of the fuel air mixture at the head of the power cylinder initiates the power or down stroke of the power piston. Thereafter, exhaust and intake occur nearly simultaneously from somewhat before the bottom dead center position of the power piston until somewhat after the bottom dead center position of the power piston. Finally, the trapped air within the power cylinder is compressed during the remainder of the power piston's up stroke through the remainder of the cycle. Thus, in the configuration of the instant invention, unlike a traditional four stroke engine in which exhaust and intake occur in two separate strokes, no entire stroke is devoted to either of these events, or to both combined. Further, the placement of the exhaust port in the combustion cylinder and the phase difference between the induction piston and the power piston of the instant invention enables the power stroke to be never less than 25 percent, and up to as much of 40 percent, of the entire cycle. Still further, because carburetion is not required for the instant invention, and thus because the crankcase is not involved in the process of inducting air and fuel into the combustion chamber, oil may be circulated in the crankcase as in a traditional four stroke engine, such that mixing of oil with the fuel becomes unnecessary and a cleaner exhaust product is produced over what has been previously attained with traditional two cycle engines.

In an alternate embodiment of the invention, the induction cylinder is replaced with an air tank storing compressed air which may be fed directly into the intake port of the combustion cylinder. The air tank receives compressed air continuously while the engine is operated, from either a turbine driven or crank shaft driven compressor.

Regardless of the source of cooled compressed air, whether it be a first induction cylinder or an air tank, in the event that carburetion becomes desired for use in the engine of the instant invention, both of the above-mentioned sources of cooled compressed air allow the air to be carbureted as it enters the power cylinder, thus avoiding contamination of the crank case.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 1:
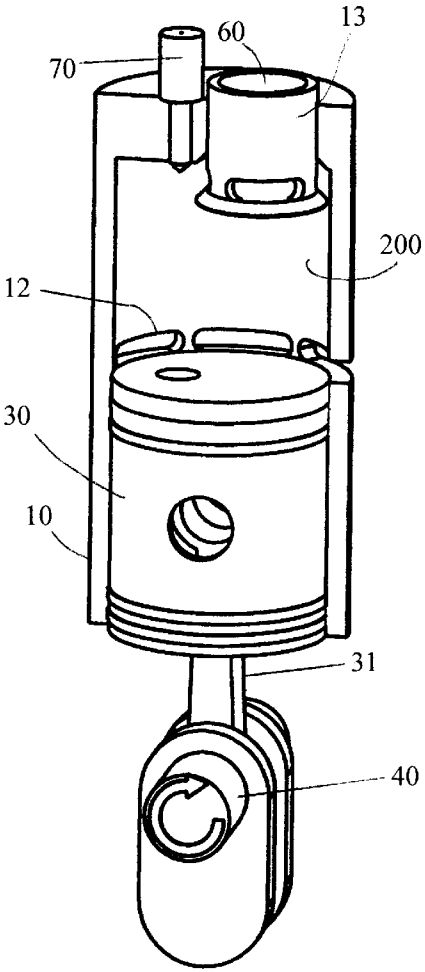
FIG. 1 is a sectional view of the internal combustion engine of the instant invention, wherein the power piston is at a top dead center position.

FIGS. 1 through 4 diagramatically depict a first embodiment of the dual cylinder, three event, internal combustion engine of the instant invention. As shown in FIG. 1, the internal combustion engine of the instant invention comprises an engine block 10 having a pair of preferably vertically oriented parallel cylinders, namely, an induction cylinder (shown generally at 100) and a power cylinder (shown generally at 200). While FIGS. 1 through 4 depict induction cylinder 100 and power cylinder 200 as vertically oriented parallel cylinders, it should be noted that the cylinders may alternately be arranged at angles to one another, as in a typical v-arrangement for an internal combustion engine. Induction cylinder 100 houses an induction piston 20 which is configured for reciprocal movement through induction cylinder 100. A standard piston rod 21 attaches induction piston 20 to a crankshaft 40 as is commonly known to those skilled in the art. Likewise, power cylinder 200 houses a power piston 30 which is configured for reciprocal movement through power cylinder 200. A standard piston rod 31 attaches power piston 30 to crankshaft 40. In the preferred embodiment of the instant invention, crankshaft 40 is configured such that induction piston 20 is phased to move 140 degrees in advance of power piston 30. However, such phase separation may vary from 90 to 180 degrees while maintaining the functionality of the instant invention. While the preferred embodiment depicted in FIGS. 1 through 4 discloses a phase difference of 140 degrees, it is important to note that the precise phase difference is a function of the location of an exhaust port 12 in power cylinder 200, and the angular position of power piston 30 during its cycle, and more particularly its downward power stroke, when power piston 30 initially uncovers exhaust port 12. The precise phase difference between induction piston 20 and power cylinder 30 is preferably 2 times the number of degrees between bottom dead center of power piston 30 (i.e., 180 degrees) and the angular position of power piston 30 during its 360 degree cycle at which it initially uncovers exhaust port 12. It has been found that this precise arrangement ensures that induction piston 20 reaches its top dead center position, thus maximally compressing the charge of air in induction cylinder 100 and ensuring transfer of that entire charge to power cylinder 200, just as power piston 30 closes exhaust port 12. This arrangement in turn assures that the maximum amount of fresh air is made available for combustion within power cylinder 200, thus increasing the efficiency of the engine of the instant invention over prior art designs which require recombustion of leftover combustion products in the power cylinder, or which utilize contaminated exhaust gasses from the engine crank case as a part of the combustion product.

An air inlet port (shown generally at 11) is provided at one end of engine block 10 and is in fluid communication with induction cylinder 100. A fresh air plenum chamber (not shown) directs fresh atmospheric air, uncontaminated from combustion byproducts of the engine cycles, to air inlet port 11. Housed within air inlet port 11 is a one way pressure responsive valve 50 (described in greater detail below) which allows fresh air to travel from the plenum chamber into induction cylinder 100 when the pressure in induction cylinder 100 falls below the pressure on the inlet side of valve 50.

In order to regulate the amount of air that is ultimately directed to the power cylinder, induction cylinder 100 may optionally be provided with a mechanically-actuated or electromechanically-actuated relief valve located near the top of induction cylinder 100. The relief valve allows air that is unwanted and unnecessary for the combustion event to occur to escape from induction cylinder 100 prior to its transfer of air to power cylinder 200. Such air is thus ejected from induction cylinder 100 untainted by fuel and exhaust, and thus creates no hazardous environmental effects. As a further form of economy, such dispelled air may be stored under pressure in a compressed air vessel and may thereafter be used to operate many pneumatic ancillary systems of numerous types in vehicles, water craft and aircraft.

A transfer port connecting the hot and cold cylinders near their "heads" (shown generally at 13) is positioned between induction cylinder 100 and power cylinder 200 to allow fluid communication between each cylinder. Housed within transfer port 13 is a one way pressure responsive transfer valve 60 (described in greater detail below) which allows a charge of compressed fresh air to travel from induction cylinder 100 to power cylinder 200 when the pressure in power cylinder 200 falls below the pressure in induction cylinder 100.

One or more exhaust ports 12 are positioned within a side wall of power cylinder 200 located near the bottom of the power piston's travel. After power piston 30 passes exhaust port 12 during its down stroke, exhaust gasses flow out of power cylinder 200 through exhaust port 12, thus decreasing the pressure in power cylinder 200 and allowing transfer valve 60 to open, in turn allowing a charge of compressed, fresh air to flow from induction cylinder 100 into power cylinder 200. While exhaust port 12 remains open, the inflow of fresh air through transfer valve 60 ensures that any remaining combustion products are displaced out of power cylinder 200. As power piston 30 moves upward, it closes exhaust port 12, thus trapping the remaining charge of fresh air for use in the next combustion event.

A fuel injection port 70 is provided at the top of power cylinder 200. Likewise, while the configuration of the instant invention is intended for use as a high compression engine which causes the combustion event to occur in power cylinder 200 as a result of the heat generated during the compression of the air/fuel mixture, a glow plug or spark plug (not shown) may optionally be provided at the top of power cylinder 200 adjacent fuel injection port 70 to further promote the combustion event.

Figure 4:
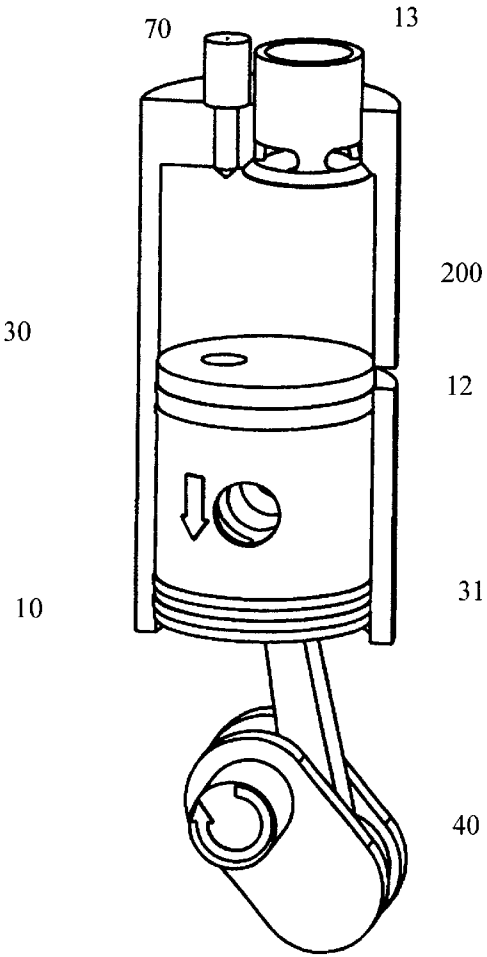
FIG. 4 is a sectional view of the internal combustion engine of the instant invention, wherein the power piston is traveling through its up stroke.
Figure 3:
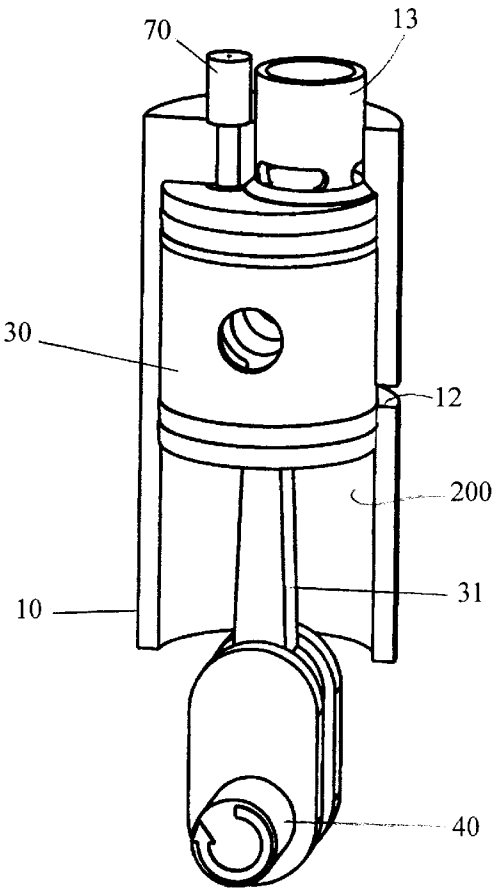
FIG. 3 is a sectional view of the internal combustion engine of the instant invention, wherein the power piston is at a bottom dead center position.

The operation of the internal combustion engine of the instant invention is carried out as follows. Referring first to FIG. 4, in which induction piston 20 is at its top dead center (TDC) position, the next movement of induction piston 20 will be downward through induction cylinder 100. At this instance, as shown in the graph of FIG. 4, the power piston position is shown at approximately 220°, or 140° from its TDC position as it is traveling upward. It is also important to note that at this instance, power piston 30 has just closed exhaust port 12 such that all fresh air remaining within power cylinder 200 will be compressed as power piston 30 continues its upward stroke.

As induction piston 20 begins to travel downward through induction cylinder 100, pressure responsive valve 50 opens as a result of the slight underpressure condition created within induction cylinder 100 as induction piston 20 begins its downward stroke. As set forth in greater detail below, the structure of valve 50 enables it to open with only a very slight underpressure condition within induction cylinder 100, such that the task traditionally placed on an internal combustion engine as a result of the vacuum draw established during an intake stroke is vastly reduced. More particularly, assuming that average atmospheric air pressure at sea level is approximately 14.7 PSI, the transfer valve 50 of the instant invention is designed such that with the transfer valve closed, less than a one pound differential pressure will be sufficient to open the valve. Such sensitivity in transfer valve 50 will ensure closure of the valve as air is trapped and begins to be compressed within power cylinder 200. As pressure responsive valve 50 opens, fresh air is 1 introduced into induction chamber 100 above induction piston 20 through air inlet 11. As shown in FIG. 1, as induction piston 20 proceeds through its downstroke within induction cylinder 100, valve 50 remains open to allow a maximum charge of fresh air to be inducted into cylinder 100. When induction piston 20 has traveled through approximately 140° (and is thus approximately 40° from bottom dead center (BDC) position), power piston 30 has reached its TDC position, fully compressing the fuel and air mixture and initiating the combustion event within power cylinder 200.

Figure 2:
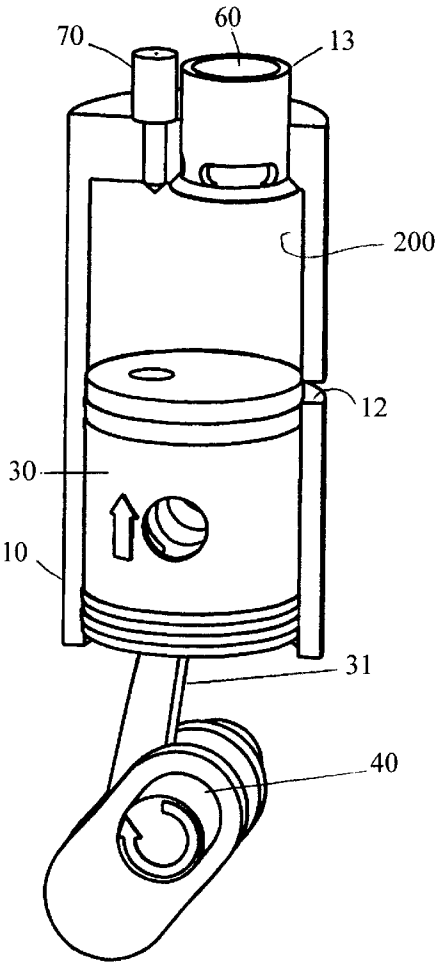
FIG. 2 is a sectional view of the internal combustion engine of the instant invention, wherein the power piston is traveling through its down stroke.

The combustion event within power cylinder 200 creates an increasing pressure at the top of power piston 30 which in turn drives power piston 30 downward as the combustion gasses expand. As shown in FIG. 2, as power piston 30 continues through its downward stroke, induction piston 20 passes its BDC position and begins its up stroke. Once induction piston 20 begins its up stroke, pressure responsive valve 50 automatically closes to allow the charge of fresh air that has been admitted to induction cylinder 100 to be compressed. Induction piston 20 then continues to compress the charge of fresh air contained within induction cylinder 100 until power piston 30 again reaches the top of exhaust port 12, at which time the exhaust event commences, allowing a drastic and near immediate reduction of pressure in power cylinder 200 when induction piston 20 is 80 degrees prior to TDC.

Immediately following the piston arrangement depicted in FIG. 2, the top edge of power piston 30 falls below the upper extent of exhaust port 12, thus starting to allow the exhaust gasses to be expelled from power cylinder 200. The sudden release of pressure within power cylinder 200 once exhaust port 12 has been exposed in turn causes pressure responsive transfer valve 60 to open, as shown more particularly in FIG. 3. As power piston 30 travels from approximately 40° prior to its BDC position (shown in FIG. 2) to its BDC position, transfer valve 50 remains open as induction piston 20 continues its upward stroke. During the time that the power piston 30 exposes exhaust port 12, power piston 30 will travel through the remainder of its downstroke approximately 11.8% of its total travel distance, and back up during its up stroke approximately another 11.8% of its total travel distance to again close exhaust port 12, at a comparatively slower rate of speed than the rise of induction piston 20 during its up stroke, which in turn rises approximately 40.5% of its total travel distance to reach its TDC position, thus further compressing the air remaining withing induction cylinder 100 and simultaneously directing it into power cylinder 200. The continuous inflow of fresh air from induction cylinder 100 to power cylinder 200 while exhaust port 12 remains open also ensures that all remaining combustion products within power cylinder 200 are washed out of power cylinder 200 until exhaust valve 12 again becomes sealed.

In an alternate embodiment of the instant invention, induction cylinder 100 is replaced with a storage vessel storing compressed air. The storage vessel is connected by a transfer chamber to the air inlet of power cylinder 200 which houses transfer valve 60. As the ventilation event allows pressure in the power cylinder to decline to less than that in the storage tank, transfer valve 60 will open to allow fresh air into the combustion cylinder.

Whether using an induction cylinder or air tank, such source of air is cooled separately from the power cylinder, such that a denser and more oxygen rich mixture is present in the combustion chamber at the onset of the ignition event than has previously been available in prior art engines. The forced flooding of the combustion chamber from the top down, as the exhaust and induction events occur simultaneously, will have the incidental advantage of collecting heat from the cylinder wall and the piston crown, as the earliest of the new air washes all the way through the cylinder as it follows the last of the exhaust.

Referring once again to FIG. 4, as induction piston 20 reaches its TDC position, power cylinder 30 reaches a position 40° past its BDC position, at which it once again closes off exhaust valve 12. Once exhaust valve 12 is closed, the cooler air which has just passed from induction cylinder 100 through transfer valve 60 into power cylinder 200 will have been absorbing heat from all the surfaces of power cylinder 200 and the crown of power piston 30, causing it to increase in pressure, thereby forcing closed transfer valve 60. The power piston 30 continues its up stroke to compress the remaining fresh air charge within power cylinder 200, while induction piston 20 starts its induction stroke. This arrangement creates a high pressure condition within power cylinder 200 which in turn causes pressure responsive transfer valve 60 to automatically close.

Figure 5:
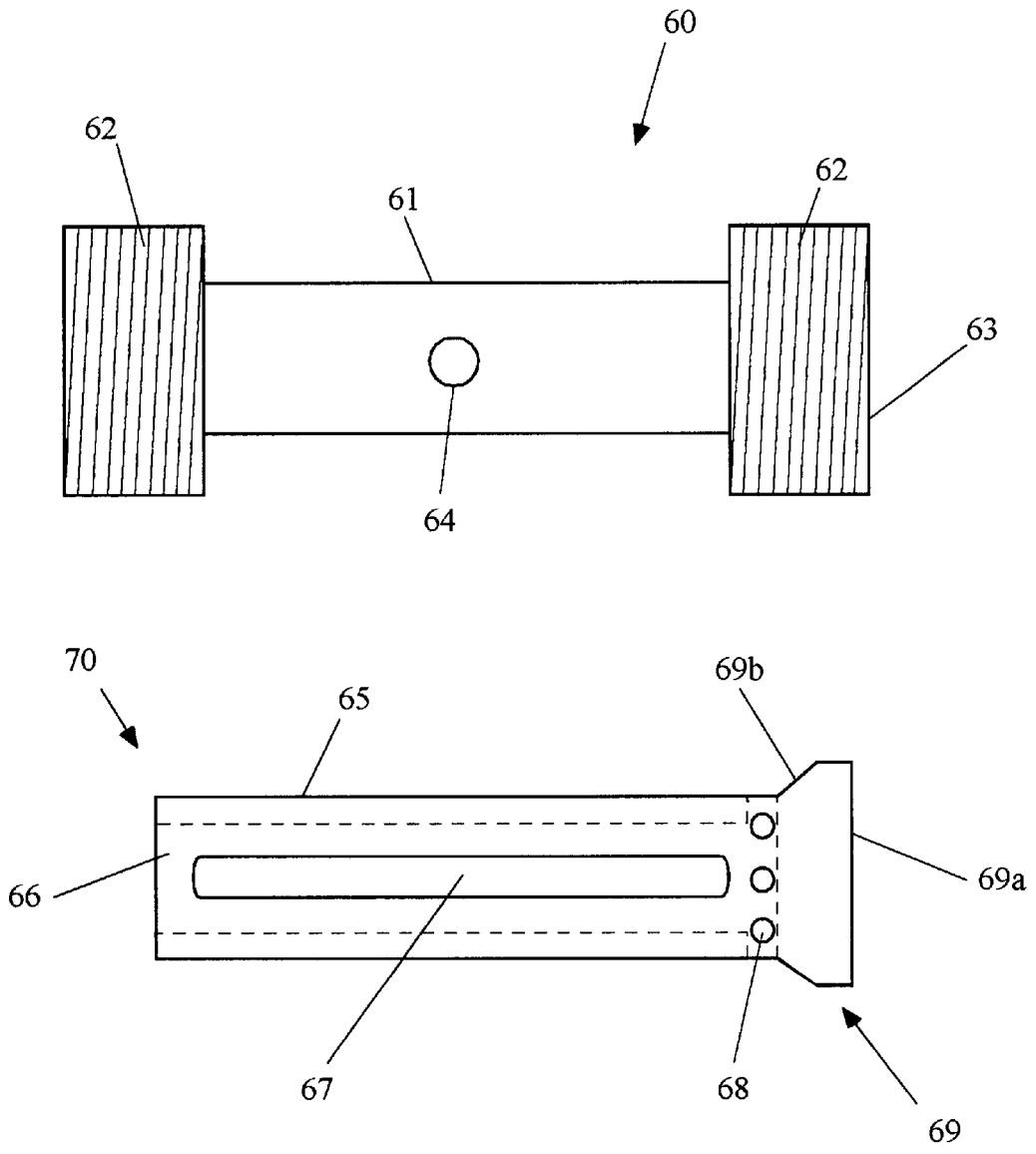
FIG. 5 is an exploded view of a transfer valve of the instant invention.

As mentioned briefly above, valves 50 and 60 are configured as pressure responsive valves which open automatically in response to a differential pressure of approximately 1 psi. In order to provide such a readily responsive valve, and as shown more particularly in FIG. 5, both valve 50 and valve 60 comprise a valve housing 61 consisting of an elongate, hollow shaft, capped at both ends with open, hollow, externally threaded mounts 62. The right most mount 62 is provided with a flat annular face 63. A pin 64 is received within a bore in valve housing 61 to slidably mount slider valve member (shown generally at 70) within valve housing 61. Slider valve member 70 comprises and elongate, cylindrical hollow shaft 65 dimensioned to slide freely within valve housing 61, and an end cap (shown generally at 69) of slightly larger diameter than shaft 65. As viewed in FIG. 5, the left most edge of shaft 65 is open to provide an open channel 66 spanning the length of hollow shaft 65. A plurality of openings 68 are provided around the circumference of shaft 65 immediately adjacent to end cap 69. The combination of hollow channel 66 and openings 68 provide a path of travel for air directed through transfer valve 60.

Slider valve member 70 is provided with an elongate slot 67 which runs generally along the length of shaft 65, and is configured to receive pin 64 when the valve is assembled. This configuration limits the path of travel of slider valve member 70 within valve housing 61, and likewise prevents the inadvertent withdrawal and removal of slider valve member 70 from housing 61 during operation. In order to establish a firm seal of slider valve member 70 against valve body 61 when the transfer valve 60 is intended to be closed, end cap 69 is provided with chamfered walls 69*b* which mate with a similarly configured opening (not shown) on mount 62, such that when the transfer valve 60 is closed, the outer most edge 69*a* of slider valve 70 is flush with the outer most edge 63 of valve housing 61.

As explained in greater detail above, it has been found that this valve arrangement ensures ease of operation of the valve in response to a differential pressure of as little as 1 psi, thus greatly reducing the load exerted on the internal combustion engine of the instant invention resulting from the vacuum load during the intake or induction stroke of the induction cylinder, while ensuring a readily responsive transfer of fresh air from induction cylinder 100 to power cylinder 200.

The power cylinder 200 of the instant invention and the induction cylinder 100 (assuming an induction cylinder as set forth in the first above-described embodiment is utilized) are each preferably lined with an inner cylinder composed of a hard and heat resistant substance such as polished cast iron, although any similar hard and heat resistant substance would likewise suffice. The inner cylinder is preferably pressed into steel block 10. Alternately, the inner cylinder 10 may be set into block 10 during the molding process, as the block may alternately be formed from a pourable material, such as concrete, ceramic slip, or epoxy. The inner cylinder is provided with a plurality of small and very numerous perforations clustered together above the BDC position of the power piston. This configuration of perforations allows a generous sectional area for exhaust while protecting the piston rings of power piston 30, and maintaining a continuously smooth surface against which the piston rings (or a ringless piston) can slide. Outside of the inner cylinder, block 10 is provided with a first exhaust plenum immediately adjacent the cylinder liner. A controllable obstruction, such as an off-center cam or similarly configured device, may optionally be provided in order to regulate the flow of exhaust gasses.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. For example, multiple devices as described above may be utilized to supply fresh air, and multiple fresh air inlet valves and transfer valves may be provided in order to increase the airflow into each respective cylinder. It should be understood, therefore, that the invention may be practiced otherwise than as specifically set forth herein.

What is claimed is:

1. In a two stroke internal combustion engine comprising an elongate power cylinder having a piston operatively connected to a drive shaft through a connecting rod and mounted for reciprocating movement therein between a top dead center position adjacent a first end of said power cylinder and a bottom dead center position adjacent a second end of said power cylinder, an air inlet adjacent said first end of said power cylinder interconnecting said power cylinder with a source of compressed air, an automatic pressure-responsive valve mounted within said air inlet, and an exhaust outlet positioned away from said second end of said power cylinder a sufficient distance such that said exhaust outlet is entirely exposed only when said piston is at said bottom dead center position and is at least partially blocked by said piston at all other times, a method of conducting a two stroke cycle within said power cylinder comprising the steps of:

a. compressing a charge of air;

b. admitting said charge of compressed air into said power cylinder in response to a pressure differential across said pressure responsive valve created by the downwardly moving piston, exposing said exhaust outlet, said charge of compressed air being admitted while said exhaust outlet is at least partially exposed c. compressing said air in the power cylinder by the upwardly moving piston with exhaust port closed and while adding fuel to said charge of air during such compression to create a compressed air/fuel mixture;

d. combusting said air/fuel mixture to drive said piston downward through said power cylinder; and e. ventilating combustion products from said power cylinder at the instant that said piston begins to expose said exhaust port during a downstroke of said piston and simultaneously with admitting fresh, cool, compressed air into said power cylinder to create an airflow along a longitudinal axis of said power cylinder from said air inlet to said exhaust outlet; whereby the creation of an airflow along a longitudinal axis of said power cylinder from said air inlet to said exhaust outlet cools said power cylinder as such air travels from said air inlet to said exhaust outlet.

2. A forced coaxially ventilated two stroke power plant comprising:

a source of compressed air; and an elongate power chamber having a first end and a second end opposite said first end, said power chamber in fluid communication with said source of compressed air, said power chamber further comprising:

a piston mounted for reciprocating movement within said power chamber between a top dead center position adjacent said first end and a bottom dead center position adjacent said second end, said piston being mounted to a connecting rod which in turn is operatively connected to a drive shaft;

an air inlet adjacent said first end, said air inlet interconnecting said source of compressed air and said power chamber;

a first automatic pressure responsive valve mounted within said air inlet for admitting a charge of compressed air from said source of compressed air in response to a pressure differential across said first pressure responsive valve; and an exhaust outlet positioned away from said second end a sufficient distance such that said exhaust port is entirely exposed only when said piston is at said bottom dead center position, and is at least partially blocked by said piston at all other times; whereby exposure of said exhaust outlet creates an airflow generally coaxial with said power chamber flowing from said air inlet to said exhaust outlet, said airflow cooling said power chamber as it flows from said air inlet to said exhaust outlet.

3. The forced coaxially ventilated two stroke power plant of claim 2, said first automatic, pressure responsive valve further comprising:

an elongate, hollow shaft having a first end and a second end, and external threads located at each of said first and second ends for mounting said shaft within said air inlet, said second end having a hollowed, partially conical indentation at an outer, exposed end thereof, and said shaft being further provided with a bore hole extending diametrically through said shaft at a position between said first and second ends; and a slider valve member configured for reciprocating movement within said shaft, said slider valve member further comprising: a hollow, elongate rod having an open first end and a closed second end; an elongate slot extending through said rod between said first end and said second end of said rod; a plurality of openings adjacent said second end of said rod providing fluid communication between an interior of said rod and an exterior environment to said valve; and an end cap adjacent said second end of said rod, said end cap having a partially conical exterior wall contoured to mate with said hollowed, partially conical surface of said second end of said shaft; and a pin extending through said bore hole and said elongate slot to reciprocally mount said slider valve within said shaft, such that said first pressure-responsive valve opens in response to an overpressure condition at a first end of said valve corresponding to said first end of said shaft, and remains closed for all underpressure conditions at said first end of said valve.

4. The forced coaxially ventilated two stroke power plant of claim 2, said source of compressed air further comprising a compressed air storage tank.

5. The forced coaxially ventilated two stroke power plant of claim 2, said source of compressed air further comprising an induction cylinder, said induction cylinder further comprising:

an air induction inlet in fluid communication with atmospheric air;

an air outlet in fluid communication with said air inlet of said power chamber; and a piston mounted for reciprocating movement within said induction cylinder between a top dead center position and a bottom dead center position.

6. The forced coaxially ventilated two stroke power plant of claim 5, further comprising:

a second automatic, pressure responsive valve mounted within said air induction inlet of said induction cylinder.

7. The forced coaxially ventilated two stroke power plant of claim 6, each said automatic, pressure responsive valve further comprising:

an elongate, hollow shaft having a first end and a second end, and external threads located at each of said first and second ends for mounting said shaft within said air inlet, said second end having a partially conical indentation at an outer, exposed end thereof, and said shaft being further provided with a bore hole extending diametrically through said shaft at a position between said first and second ends; and a slider valve member configured for reciprocating movement within said shaft, said slider valve member further comprising:

a hollow, elongate rod having an open first end and a closed second end;

an elongate slot extending through said rod between said first end and said second end of said rod;

a plurality of openings adjacent said second end of said rod providing fluid communication between an interior of said rod and an exterior environment to said valve; and an end cap adjacent said second end of said rod, said end cap having a partially conical exterior wall contoured to mate with said hollowed conical surface of said second end of said shaft; and a pin extending through said bore hole and said elongate slot to reciprocally mount said slider valve within said shaft, such that said valve opens in response to an overpressure condition at a first end of said valve corresponding to said first end of said shaft, and remains closed for all underpressure conditions at said first end of said valve.

8. A forced coaxially ventilated two stroke power plant comprising:

air supply means for supplying compressed air;

first automatic pressure responsive valve means in fluid communication with said air supply means for admitting a charge of said compressed air from said air supply means in response to a pressure differential;

an elongate power cylinder in fluid communication with said first automatic pressure responsive valve means having a first end and a second end opposite said first end, and piston means operatively connected to a drive shaft and mounted for reciprocal movement within said power cylinder between a top dead center position adjacent said first end and a bottom dead center position adjacent said second end, said power cylinder in fluid communication with said air supply means, said power cylinder configured for compressing a mixture of fuel and air and thereafter combusting said mixture to transfer power through said piston means to a drive shaft;

and means for cooling said power cylinder along its longitudinal axis during ventilation of said power cylinder.

9. The forced coaxially ventilated two stroke power plant of claim 8, said means for cooling said power cylinder further comprising:

air inlet means interconnecting said power cylinder and said air supply means;

exhaust means; and said first pressure responsive valve means being mounted within said air inlet means.

10. The forced coaxially ventilated two stroke power plant of claim 9, wherein said air inlet means is positioned adjacent said first end, and said exhaust means is positioned away from said second end a sufficient distance such that said exhaust port is entirely exposed only when said piston is at said bottom dead center position, and is at least partially blocked by said piston at all other times.

11. The forced coaxially ventilated two stroke power plant of claim 10, wherein said first automatic, pressure responsive valve means is configured to automatically open upon ventilation of said power cylinder through exposure of said exhaust means, such that an airflow generally coaxial with said power cylinder is generated flowing from said air inlet means to said exhaust means, and cools said power cylinder as it flows from said air inlet means to said exhaust means.

12. The forced coaxially ventilated two stroke power plant of claim 11, said first automatic, pressure responsive valve means further comprising:

an elongate, hollow shaft having a first end and a second end, and external threads located at each of said first and second ends for mounting said shaft within said air inlet, said second end having a partially conical indentation at an outer, exposed end thereof, and said shaft being further provided with a bore hole extending diametrically through said shaft at a position between said first and second ends; and a slider valve member configured for reciprocating movement within said shaft, said slider valve member further comprising: a hollow, elongate rod having an open first end and a closed second end;

an elongate slot extending through said rod between said first end and said second end of said rod:

a plurality of openings adjacent said second end of said rod providing fluid communication between an interior of said rod and an exterior environment to said valve; and an end cap adjacent said second end of said rod, said end cap having a partially conical exterior wall contoured to mate with said hollowed conical surface of said second end of said shaft; and a pin extending through said bore hole and said elongate slot to reciprocally mount said slider valve within said shaft, such that said valve opens in response to an overpressure condition at a first end of said valve corresponding to said first end of said shaft, and remains closed for all underpressure conditions at said first end of said valve.

13. The forced coaxially ventilated two stroke power plant of claim 9, said air supply means further comprising a compressed air storage tank.

14. The forced coaxially ventilated two stroke power plant of claim 9, said air supply means further comprising an induction cylinder having a first end and a second end, said induction cylinder further comprising:

an air induction inlet in fluid communication with atmospheric air;

an air outlet in fluid communication with said air inlet means of said power cylinder; and a piston mounted for reciprocating movement within said induction cylinder between a top dead center position adjacent said first end of said induction cylinder and a bottom dead center position adjacent said second end of said induction cylinder.

15. The forced coaxially ventilated two stroke power plant of claim 14, further comprising a second automatic, pressure responsive valve means mounted within said air induction inlet.

16. The forced coaxially ventilated two stroke power plant of claim 15, each said automatic, pressure responsive valve means comprising:

an elongate, hollow shaft having a first end and a second end, and external threads located at each of said first and second ends for mounting said shaft within said air inlet, said second end having a partially conical indentation at an outer, exposed end thereof, and said shaft being further provided with a bore hole extending diametrically through said shaft at a position between said first and second ends; and a slider valve member configured for reciprocating movement within said shaft, said slider valve member further comprising:

a hollow, elongate rod having an open first end and a closed second end;

an elongate slot extending through said rod between said first end and said second end of said rod;

a plurality of openings adjacent said second end of said rod providing fluid communication between an interior of said rod and an exterior environment to said valve; and an end cap adjacent said second end of said rod, said end cap having a partially conical exterior wall contoured to mate with said hollowed conical surface of said second end of said shaft; and a pin extending through said bore hole and said elongate slot to reciprocally mount said slider valve within said shaft, such that said valve opens in response to an overpressure condition at a first end of said valve corresponding to said first end of said shaft, and remains closed for all underpressure conditions at said first end of said valve.

17. A forced coaxially ventilated two stroke power plant comprising:

an elongate power cylinder having a first end and a second end opposite said first end, and piston means operatively connected to a drive shaft and mounted for reciprocal movement within said power cylinder between a top dead center position adjacent said first end and a bottom dead center position adjacent said second end;

air supply means in fluid communication with said elongate power cylinder centrally at said first end for supplying air proximate the top dead center position of said piston means;

first automatic pressure responsive valve means in fluid communication with said air supply means for admitting a charge of said compressed air from said air supply means in response to a pressure differential;

an exhaust port in fluid communication with said elongate power cylinder proximate said second end for exhausting combustion product proximate the bottom dead center position of said piston means.

* * * * *